US008912772B2

(12) United States Patent
Childs

(10) Patent No.: US 8,912,772 B2
(45) Date of Patent: Dec. 16, 2014

(54) LDO WITH IMPROVED STABILITY

(75) Inventor: Mark Childs, Lydiard Millicent (GB)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 630 days.

(21) Appl. No.: 13/066,598

(22) Filed: Apr. 19, 2011

(65) Prior Publication Data

US 2012/0262135 A1 Oct. 18, 2012

(30) Foreign Application Priority Data

Apr. 13, 2011 (EP) ..... 11368014

(51) Int. Cl.
*G05F 1/59* (2006.01)
*G05F 1/575* (2006.01)
*G05F 3/26* (2006.01)

(52) U.S. Cl.
CPC *G05F 1/575* (2013.01); *G05F 1/59* (2013.01); *G05F 3/26* (2013.01)
USPC ..... 323/269; 323/273; 323/280

(58) Field of Classification Search
USPC ..... 323/269, 273, 275, 279, 280
See application file for complete search history.

(56) References Cited

U.S. PATENT DOCUMENTS 5,600,234 A 2/1997 Hastings et al.
5,672,959 A 9/1997 Der
6,340,918 B2 * 1/2002 Taylor ..... 330/292
6,856,124 B2 2/2005 Deam et al.
6,977,490 B1 * 12/2005 Zhang et al. ..... 323/280
7,323,853 B2 1/2008 Tang et al.
7,589,507 B2 9/2009 Mandal
7,656,139 B2 2/2010 van Ettinger
7,679,437 B2 3/2010 Tadeparthy et al.
7,710,091 B2 5/2010 Huang
7,872,454 B2 1/2011 Sutardja
8,154,263 B1 * 4/2012 Shi et al. ..... 323/269
2003/0178976 A1 * 9/2003 Xi ..... 323/273
2006/0055383 A1 * 3/2006 Eberlein ..... 323/280
2008/0238381 A1 * 10/2008 Luo ..... 323/269
2010/0052635 A1 * 3/2010 Wang ..... 323/280

FOREIGN PATENT DOCUMENTS

WO WO 2007/009484 1/2007

OTHER PUBLICATIONS

European Search Report 11368014.4-2206 Mail Date—Oct. 31, 2012, Dialog Semiconductor GmbH.

* cited by examiner

*Primary Examiner* — Fred E Finch, III
(74) *Attorney, Agent, or Firm* — Saile Ackerman LLC; Stephen B. Ackerman

(57) ABSTRACT

A low drop-out (LDO) voltage regulator which parallels a second pass device to a first pass device, where the second pass device has in series a small resistor. The small value resistor is a substitute for bond wires or capacitors with very low equivalent series resistances (ESR). A fast feedback loop is coupled to the junction of the second pass device and the small resistor and provides, via a Miller capacitor, a feedback signal to the amplifier of the voltage regulator. The added second pass device returns circuit stability by moving the fast-loop high frequency zero node back within the bandwidth of the circuit.

22 Claims, 7 Drawing Sheets

FIG. 1 – Prior Art

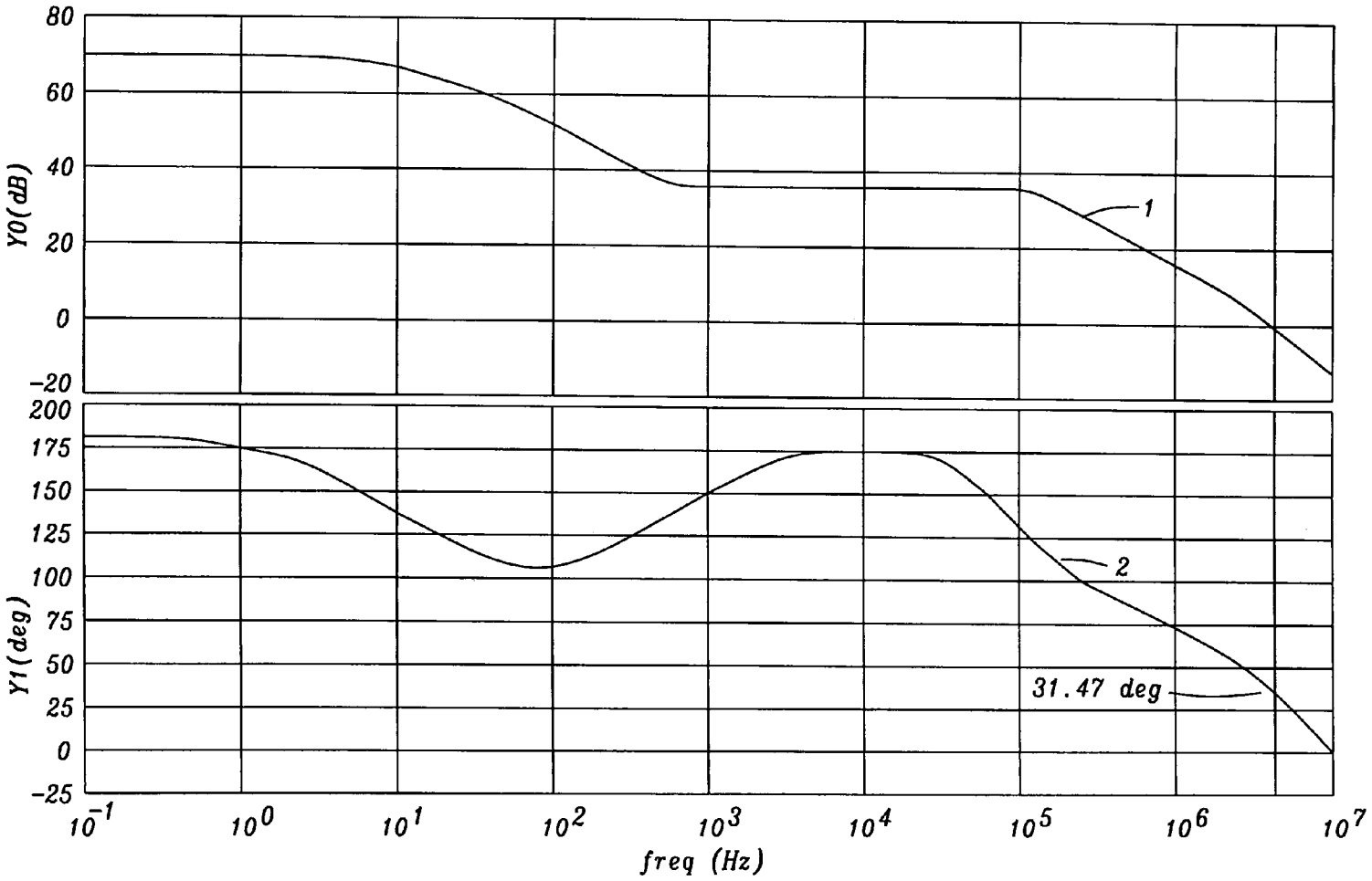
FIG. 3a – Prior Art

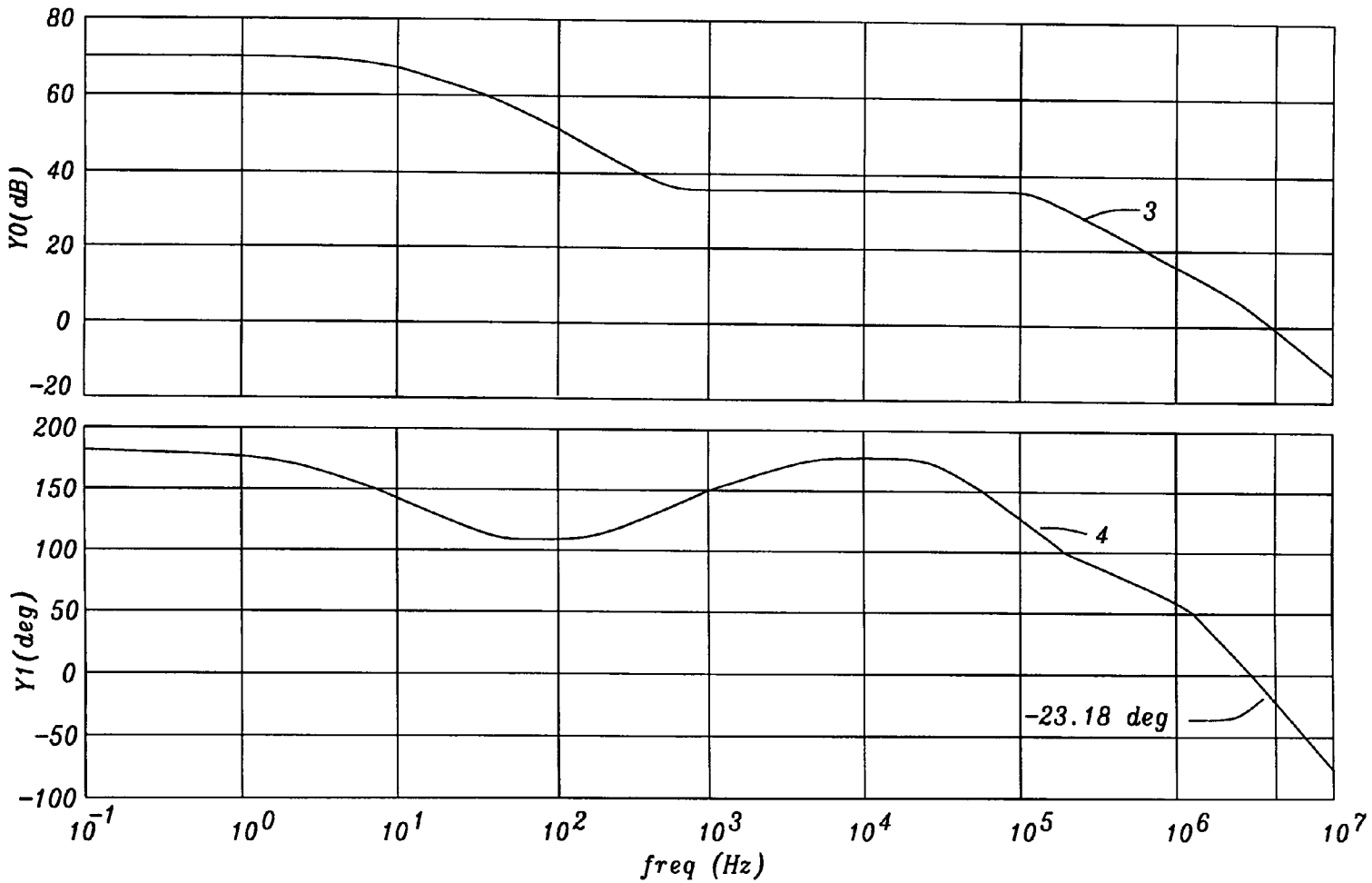
FIG. 3b – Prior Art

LDO WITH IMPROVED STABILITY

BACKGROUND OF THE INVENTION

1. Field of the Invention

The invention relates to a low drop-out (LDO) voltage regulator, and more particularly to eliminating stability problems for LDOs with very low bond wire resistance or no bond wires at all.

2. Description of the Related Art

Currently, low drop-out (LDO) voltage regulators which use advanced techniques usually require that the bond wire impedance is within a reasonably tightly controlled range in order that the LDO is stable. However, the move to advanced package types will mean that no bond wires are used where these LDOs easily become unstable. Many solutions to the above problems associated with unstable LDOs have been proposed in the related art, many with complex and thus costly schemes. Reference is made to U.S. Pat. No. 6,856,124, entitled "LDO Regulator With Wide Output Load Range And Fast Internal Loop" issued Feb. 15, 2005 and assigned to the assignee of this application. That patent shows a method and a circuit to achieve a low drop-out voltage regulator with a wide output load range. A fast loop is introduced in the circuit. The circuit is internally compensated and uses a capacitor to ensure that the internal pole is more dominant than the output pole as in standard Miller compensation. The quiescent current is set being proportional to the output load current. No explicit low power drive stage is required. The whole output range is covered by one output drive stage. This technique however does not address the above mentioned problem with the very low resistances that are associated with the absence of bond wires. What is needed is an easy-to-implement and cost effective solution which will insure that the LDO remains stable with a minimal amount of degradation in performance or current consumption. These needs are met by the present invention, which assures a stable circuit between equivalent series resistance (ESR) ranges of 100 mΩ and 1 mΩ.

U.S. patents which relate to the subject of the present invention are:

U.S. patent application Ser. No. 7,710,091 B2 (Huang) discloses an LDO voltage regulator which utilizes nested Miller compensation and pole-splitting to move the dominant pole to the output of a first-stage amplifier. An active resistor is arranged in the feedback path of a Miller capacitor to increase the controllability of the damping factor.

U.S. patent application Ser. No. 7,679,437 B2 (Tadeparthy et al.) describes a split feedback technique and a scheme for improving the degradation of load regulation caused by additional metal resistance in an amplifier (an LDO) of the type wherein a feedback loop for the amplifier is deployed and where the feedback loop might be viewed as including a feedback resistance and a capacitance connected in parallel.

U.S. Pat. No. 7,656,139 B2 (van Ettinger) shows a negative feedback amplifier system in which part of the supplied output current is diverted through a first "zero" resistor before adding it to the output voltage, and also using a second "boost zero" compensating resistor between the amplifier and the first current control element.

U.S. Pat. No. 7,589,507 B2 (Mandal) teaches a stability compensation circuit for an LDO driving a load capacitor in a range of few nano-Farads to few hundreds of nano-Farads with a good phase margin over a no load to full load current range, and maintains minimum power area product for an LDO suitable for a SoC integration.

U.S. Pat. No. 7,323,853 B2 (Tang et al.) presents an LDO voltage regulator which comprises an error amplifier with a common-mode feedback unit, a pass device, a feedback circuit, and a compensation circuit to provide a stable output voltage with a high slew rate and simple configuration when the load capacitance has a large range.

It should be noted that none of the above-cited examples of the related art provide the advantages of the below described invention.

SUMMARY OF THE INVENTION

It is an object of at least one embodiment of the present invention to provide a low drop-out voltage regulator and a method to mimic the external equivalent series resistance of the bond wire.

It is another object of the present invention to allow very quick and easy porting of one design of a low drop-out voltage regulator to different packages.

It is yet another object of the present invention to improve the phase margin of the low drop-out voltage regulator to be well within the positive range.

It is still another object of the present invention to provide a low drop-out voltage regulator which is stable with very little degradation in performance or current consumption.

It is a further object of the present invention is to provide a low drop-out voltage regulator which is suitable for applications where no bond wires are used.

These and many other objects have been achieved by splitting the main pass device into two unequal parts, by placing a controlled impedance in series with the smaller part of the pass device, and to take the fast feedback loop from the node between the pass device and the impedance and couple it back to the Miller capacitor. The channel width of the smaller part of the pass device is dimensioned to be about one twentieth the width of the larger pass device. The impedance coupled to the smaller part of the pass device has a resistance of typically 2 Ω but which can vary in size depending on specific requirements.

These and many other objects and advantages of the present invention will be readily apparent to one skilled in the art to which the invention pertains from a perusal of the claims, the appended drawings, and the following detailed description of the preferred embodiments.

BRIEF DESCRIPTION OF THE DRAWINGS

FIGS. 3*a* and 3*b* are graphs of the conventional LDO of FIG. 1, showing magnitude and phase response versus frequency for an ESR of 100 mΩ and 1 mΩ, respectively.

Use of the same reference number in different figures indicates similar or like elements.

DESCRIPTION OF THE PREFERRED EMBODIMENT

Figure 1:
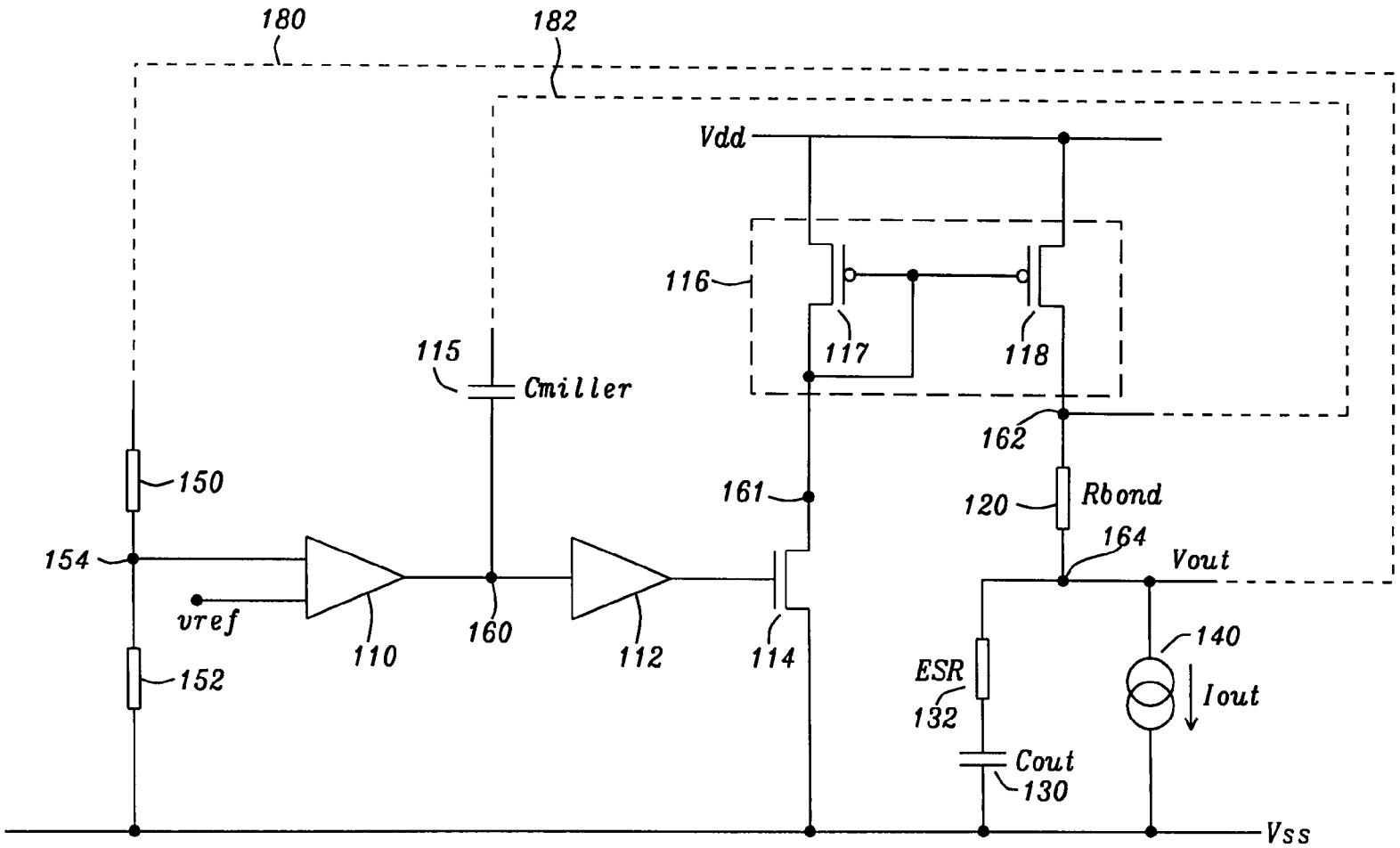
FIG. 1 is a block diagram of a conventional LDO circuit.

FIG. 1 shows in more detail the low drop-out voltage regulator (LDO) 100 of the above referenced U.S. Pat. No. 6,856,124. A differential amplifier 110 couples via node 160 to a buffer 112 which drives nmos transistor 114 with output node 161. A current mirror stage 116 is coupled to output node 161 and drives the current mirror output pmos transistor 118, the main pass device.

The current mirror input is pmos transistor 117. The output 162, the drain of pmos transistor 118, couples to wire bond (Rbond) 120. The other side of wire bond 120 couples to node (Vout) 164 of LDO 100. Also shown but not strictly part of the circuit are:

capacitor (Cout) 130 with its intrinsic equivalent series resistance (ESR) 132 and current source (Iout) 140 coupled between node 164 and Vss (typically Ground).

A main feedback loop 180 couples from node (Vout) 164 via resistors 150 and 152 to Vss. The junction of resistors 150 and 152 is node 154 which is one of the two inputs to differential amplifier 110. The other input is a reference voltage Vref. A fast feedback loop 182, couples from node 162 via capacitor (Cmiller) 115 to node 160, the input to buffer 112.

In the current design practice, per FIG. 1, an internally compensated design with a 'smart-mirror' drive scheme is used and comprises buffer 112 plus the two transistors 114 and 117. This smart-mirror controls the output of transistor 118, the buffer 112 can be low power while transistors 114 and 117 pass current in proportion to the output power of the LDO, meaning that when the pass device is lightly loaded, the drive current is reduced. Conversely, large voltage swings on the pass device gate are driven by similar large bias currents through the driver. The current design practice takes this further by using the mirrored currents as a large fraction of the bias currents in the preceding amplifier stage 110 and buffer 112 of the LDO.

To regulate the output (Vout) the main feedback loop 180 is included. This feedback loop divides down the output voltage of the LDO with a resistive chain (150 and 152), and then amplifies this result with respect to a 1.2V reference Vref. This amplifies the error in the output voltage Vout and so regulates the output. This feedback loop is held stable by a low voltage pole added by the internal-compensation Miller-capacitor. This means the LDO has high gain at DC but the gain of this main feedback loop is low at high frequencies.

In order to improve the performance of the LDO at higher frequencies a fast feedback loop (182) is included. This feedback loop is formed by the existing Miller capacitor and provides a means of feedback for high-frequency disturbances at the output 162 directly to the input of the smart-mirror stage. This feedback loop can be visualized as such: any high-frequency current signal should be supplied directly from the load capacitor (Cout) 130, which will look like a short to ground (Vss). However, the series impedance of the capacitor 130 will mean that a small voltage will be developed across the capacitor component. This voltage can be passed back to the input of buffer 112 and used to correct the output current without seeing any low-frequency poles. Since the Miller capacitor is connected before the output bond i.e. wire bond (Rbond) 120, the impedance of these bonds is also included with the capacitor (Cout) 130 ESR.

Recently the ESR of the wire bonds and of the capacitors have fallen to the extent that this fast feedback loop 182 high-frequency zero node has moved out of the bandwidth of the LDO, and the fast feedback loop has become unstable. As the move to copper bond wires or CSP (Chip Scale Packaging) packages will further reduce the ESR. The present invention addresses this problem and provides a solution as described below.

Proposal

Case 1: One solution is to place a series resistor between the pass device and the output Vout, artificially increasing the equivalent ESR. However, this fix will impact the drop-out voltage of the LDO and the load-transient behavior. For output load models we have assumed an equivalent ESR of 100 mΩ. With this ESR, a simulation run shows that the LDO has a phase-margin of about 40° at 100 mA output current, Vout=2.4V and Vdd=3V. If this ESR is reduced to the unlikely case of 1 mΩ, then this phase margin falls to about −5°.

Referring to FIG. 3*a*, we show a graph of a computer simulation of Case 1 and an ESR of 100 mΩ with Vout=2.4V and Vdd=3V, for an output current of 100 mA as described above. The horizontal axis displays frequency in Hz ranging from $10^{-1}$ to $10^{7}$. The vertical axis displays Y0 in db for output and Y1 in degrees for the phase. Curve 1 shows the magnitude of the output signal Vout, Curve 2 shows the phase. At Vout=0 the phase margin is 31.47° i.e. the circuit is stable.

Referring to FIG. 3*b*, we show a graph of a computer simulation of Case 1 and an ESR of 1 mΩ with Vout, Vdd=3V and output current as described above. Curve 3 shows the magnitude of the output signal Vout, Curve 4 shows the phase. At Vout=0 the phase margin is −23.18° i.e. the circuit is unstable.

Case 2: In the preferred embodiment of the present invention, and referring to FIG. 2, we propose to add another pass device in parallel with the main pass device. A more detailed description of this new circuit follows below. This pass device 218 would be typically about 5% of the existing 100% channel width of the main pass 118 device, but pass device 218 may range from between about 1 to 10% but preferably ranges from between about 0.5 to 15% of the existing channel width of the main pass device. The new pass device will share the power connection and the gate connection. However, between the drain and the output of the LDO is placed a resistor of typically about 2 Ω but which may range from between about 1 to 5 Ω but preferably ranges from between about 0.5 to 10 Ω. The Miller capacitor is now connected to the drain of this new pass device. This means the Miller capacitor sees a much greater ESR, and so it amplifies the fast feedback loop gain, moving the zero node back within the bandwidth. The major pass device still has low ESR, and so the drop-out performance remains unchanged. In this case the phase-margin now exceeds the previous 100 mΩ ESR environment.

Again referring to FIG. 2, we now describe the low drop-out voltage regulator (LDO) 200 of the preferred embodiment of the present invention:

The present invention is different in several main aspects from the conventional circuit of FIG. 1. Current mirror stage 116 is replaced by current mirror stage 216 which uses a third and smaller current mirror pmos transistor as pass device 218, as discusses above. Another difference is that the drain of pass device 218 is coupled via node 262 to a small resistor 220 which in turn is coupled to output node 162. The main feedback loop 180 is unchanged but a new fast feedback loop 282 is coupled from node 262 via capacitor (Cmiller) 115 to node 160, the input to buffer 112.

Figure 3C:
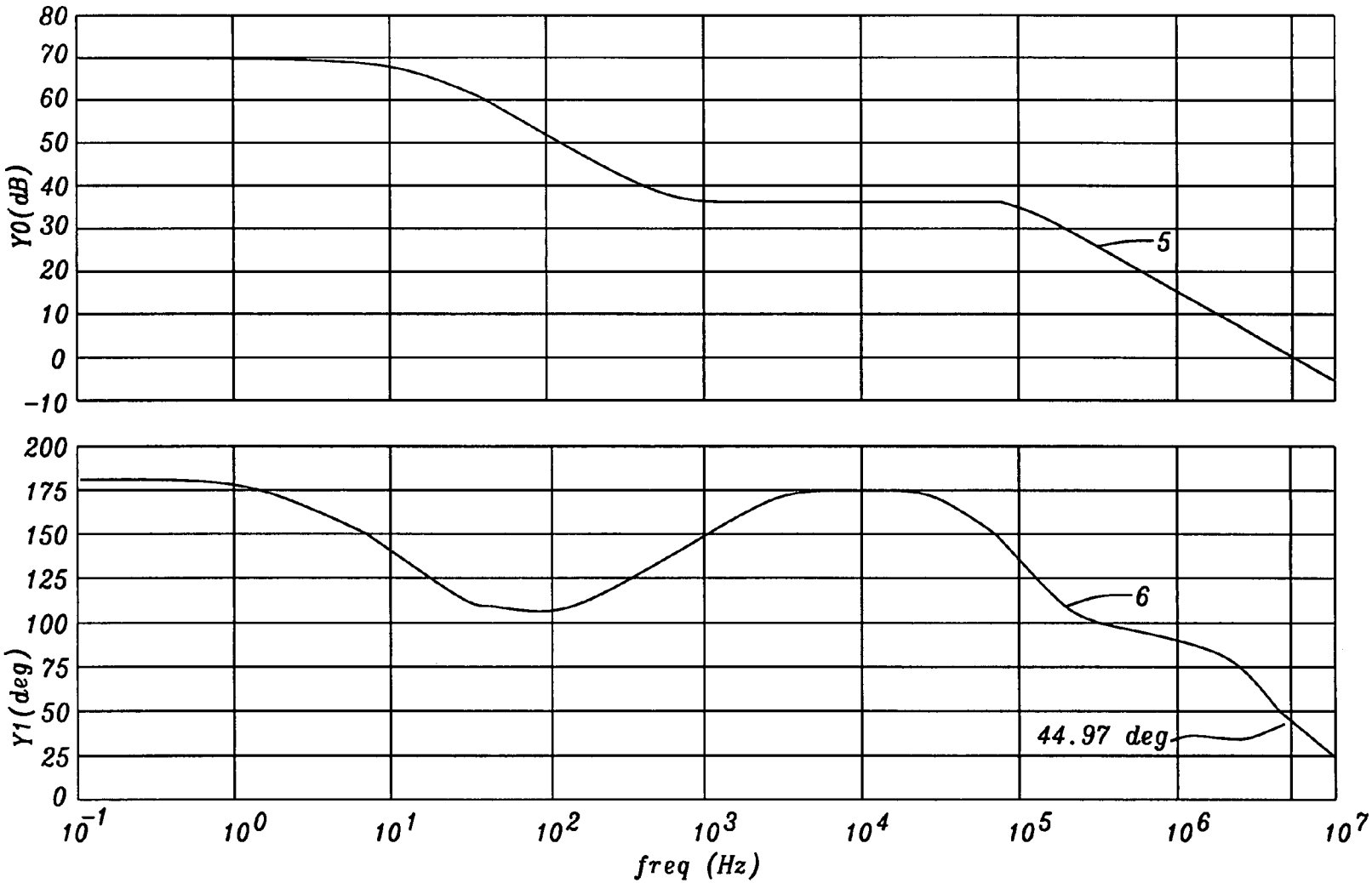
FIGS. 3*c* and 3*d* are graphs of the LDO of FIG. 2, showing magnitude and phase response versus frequency at the output of the LDO for an ESR of 100 mΩ and 1 mΩ), respectively.

Referring now to FIG. 3*c* we show a graph of a computer simulation of Case 2, the preferred embodiment of the present invention, with the same conditions as for Case 1, that is with and an ESR of 100 mΩ and Vout=2.4V and Vdd=3V, for an output current of 100 mA. The horizontal axis displays frequency in Hz ranging from $10^{-1}$ to $10^{7}$. The vertical axis displays Y0 in db for output and Y1 in degrees for the phase. Curve 5 shows the magnitude, Curve 6 shows the phase of the output signal Vout. It can be seen that at Vout=0 the phase margin has improved to 44.97°.

Figure 3D:
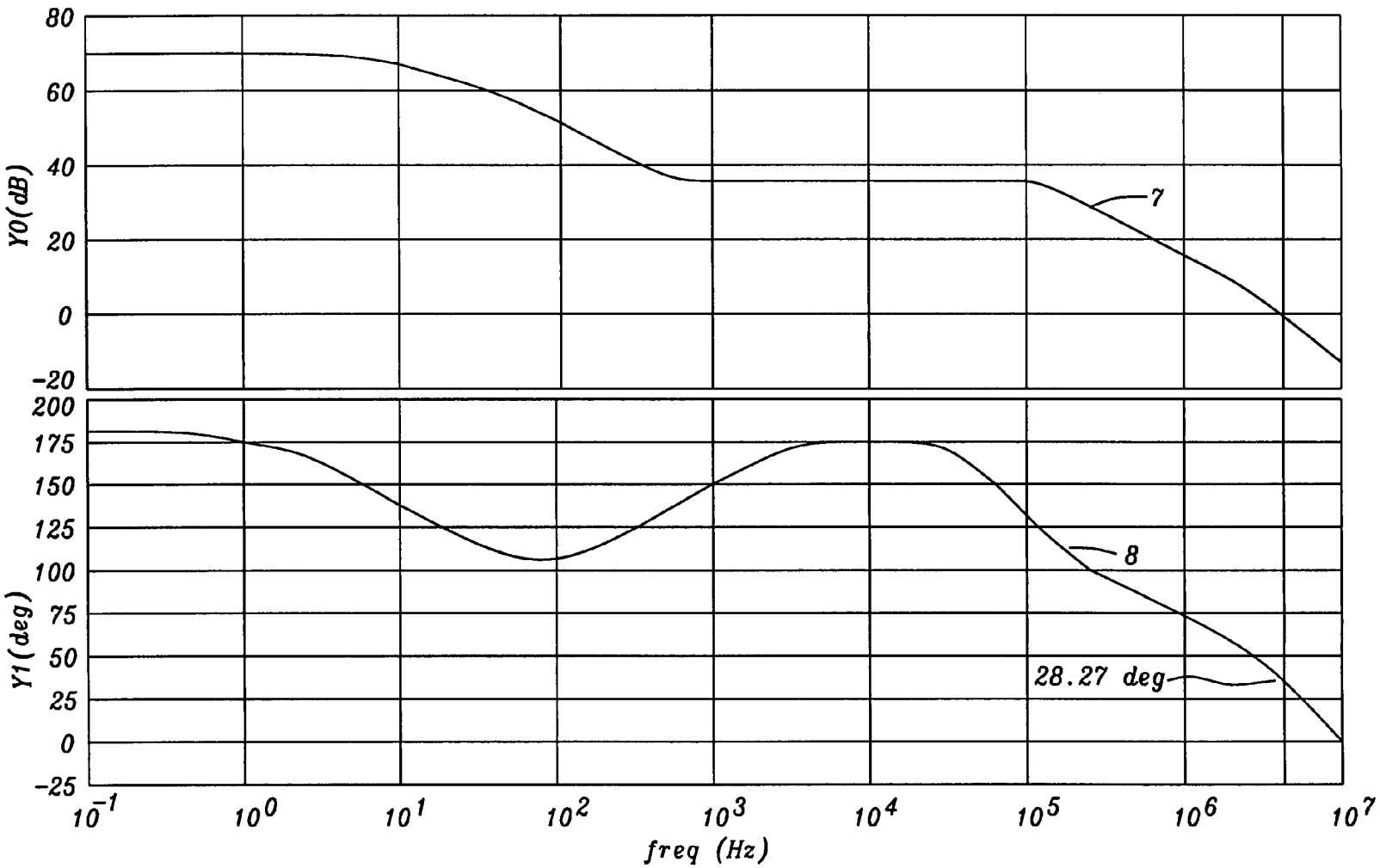

Referring to FIG. 3*d*, we show a graph of a computer simulation of Case 2 and an ESR of 1 mΩ with Vout, Vdd=3V and output current as described above. Curve 7 shows the magnitude of the output signal Vout, Curve 8 shows the phase. It can be seen that at Vout=0 the phase margin has improved to 28.27° i.e. the circuit is now stable.

Figure 2:
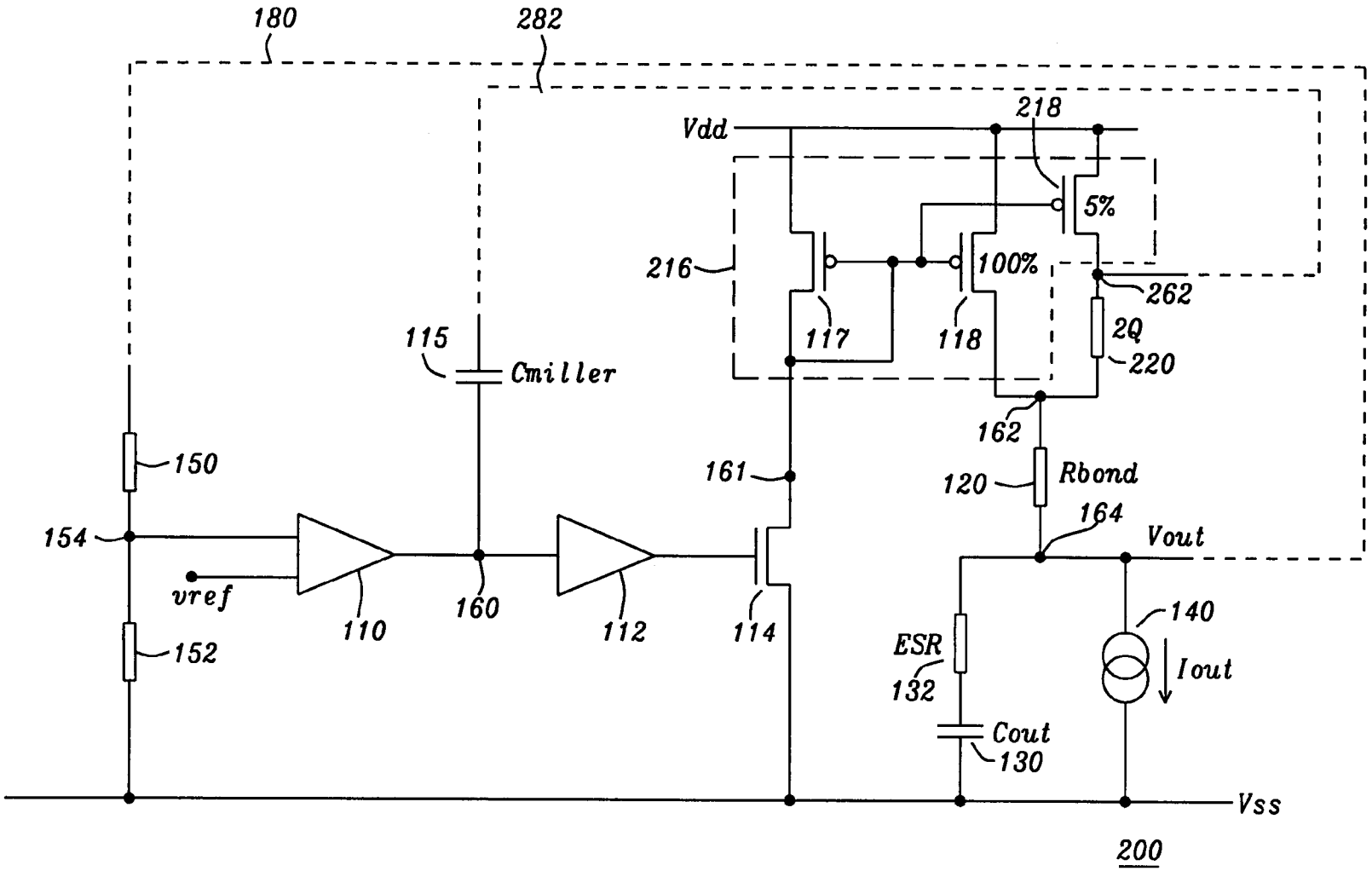
FIG. 2 is a circuit diagram of the preferred embodiment of the present invention.

Referring again to the low drop-out voltage regulator 200 of FIG. 2, we provide a second description of the preferred embodiment of the present invention:

Shown is an amplifier 110 which amplifies input signals, having as inputs an input node 154 and a reference node Vref and an output node 160;

a buffer 112, followed by an nmos transistor 114, having its buffer input node coupled to the amplifier output node and further having an output node 161;

a pass device 216 of a current mirror, the pass device having its input node coupled to the buffer output node, and having an output node 162, where the pass device further comprises;

a first pmos transistor 118, representing a first output side 162 of the current mirror, where the drain of the first pmos transistor is coupled to the pass device output node;

a second pmos transistor 218 representing a second output side of the current mirror, where the second pmos transistor, in series with resistor 220, is in parallel with the first pmos transistor and where the junction of the second pmos transistor and resistor provides a feedback node 262;

the second pmos transistor 218, in series with resistor 220 and a bond wire 120 coupled to a low drop-out voltage regulator output node 164;

a main feedback loop 180 which regulates the output voltage Vout at the low drop-out voltage regulator output node, where one end is coupled to the low drop-out voltage regulator output node and the other end is coupled to the amplifier input node; and a fast feedback loop 282 which feeds back high-frequency disturbances from the low drop-out voltage regulator output node, the fast feedback loop comprising a Miller feedback capacitor 115, where one end of the fast feedback loop is coupled to the feedback node and where the other end is coupled to the buffer input node.

The differential amplifier 110 and buffer 112 mentioned above and in subsequent descriptions below may be some other type of amplifier and implies a device which amplifies a signal, and may be a transistor or a transistor circuit, either of these in discrete form or in integrated circuits (IC) depending on the particular implementation of the LDO voltage regulator. These devices are cited by way of illustration and not of limitation, as applied to amplifiers.

The pmos transistors mentioned above and in subsequent descriptions below may be substituted with nmos transistors, or a mix of MOS transistors or other transistor types, and imply devices such a transistor circuit, either of these in discrete form or in integrated circuits (IC), depending on the particular implementation of the LDO voltage regulator. These devices are cited by way of illustration and not of limitation, as applied to transistors.

Capacitors mentioned above and in subsequent descriptions below may be implemented as a transistor, transistors or a transistor circuit, either of these in discrete form or in integrated circuits (IC). These devices are cited by way of illustration and not of limitation, as applied to capacitors.

Figure 4:
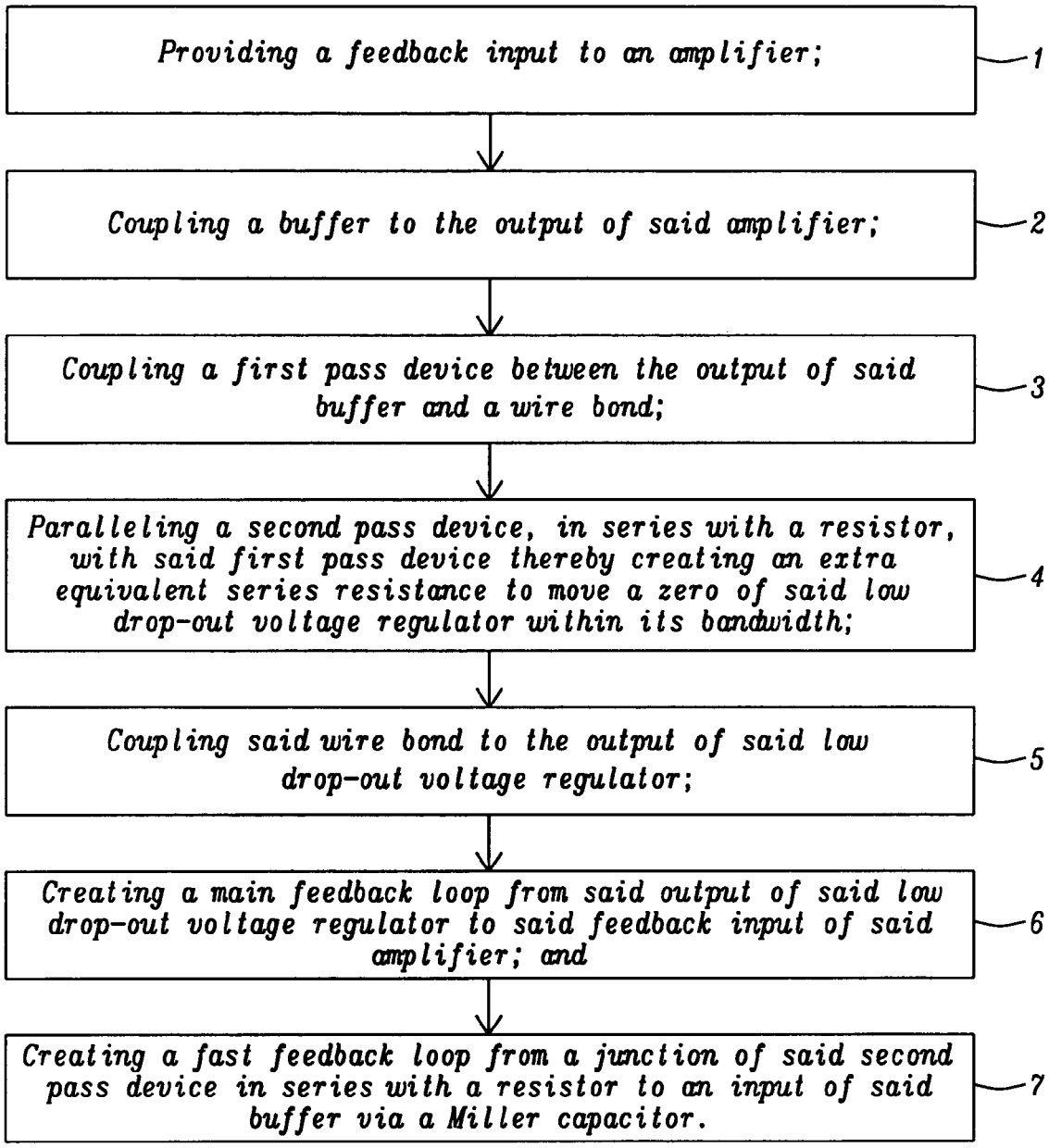
FIG. 4 is a block diagram of the method of the present invention.

We now describe with reference to FIG. 4 a preferred method of the present invention to move a fast loop high-frequency zero node back into the bandwidth of the LDO:

Block 1 provides a feedback input to an amplifier;

Block 2 couples a buffer to the output of the amplifier;

Block 3 couples a first pass device between the output of the buffer and a wire bond;

Block 4 parallels a second pass device, in series with a resistor, with the first pass device thereby creating an extra equivalent series resistance to move a zero of the low drop-out voltage regulator within its bandwidth;

Block 5 couples the wire bond to the output of the low drop-out voltage regulator;

Block 6 creates a main feedback loop from the output of the low drop-out voltage regulator to the feedback input of the amplifier; and Block 7 creates a fast feedback loop from a junction of the second pass device in series with a resistor to an input of the buffer via a Miller capacitor.

While the invention has been particularly shown and described with reference to the preferred embodiments thereof, it will be understood by those skilled in the art that various changes in form and details may be made without departing from the spirit and scope of the invention.

What is claimed is:

1. A modified low drop-out voltage regulator, comprising:

an amplifier stage comprising:

an amplifier having an input and an output; where the input is the output of a low drop-out voltage regulator output node;

a buffer having an input and an output, its input coupled to said output of said amplifier, to buffer the output signal of said amplifier, said buffer providing an output signal;

a first pass device of an output stage in communication with said buffer output to provide a first current at a first output node of said output stage;

a second pass device of said output stage in communication with said buffer output to provide a second current at a second output node of said output stage;

a bond wire coupled at one end to said first output node and at its other end to said low drop-out voltage regulator output node;

a resistive means, in series with said bond wire, coupled between said second output node and said low drop-out voltage regulator output node;

a main feedback loop to regulate an output voltage Vout at said low drop-out voltage regulator output node, where one end is coupled to the junction of said bond wire and said low drop-out voltage regulator output node and the other end is in communication with said amplifier input; and a fast feedback loop to feed back high-frequency disturbances, where one end of said fast feedback loop is coupled to said second output node and where the other end is coupled to said buffer input node, said fast feedback loop comprising a Miller feedback capacitor.

2. The modified low drop-out voltage regulator of claim 1, wherein said main feedback loop comprises a voltage divider having a center node, where said center node is coupled to said amplifier input.

3. The modified low drop-out voltage regulator of claim 1, wherein said output voltage Vout is generated by a voltage divider comprising the resistance of said bond wire and an equivalent series resistance (ESR) of a load capacitor.

4. The modified low drop-out voltage regulator of claim 1, wherein said amplifier receives a reference voltage at a reference node input.

5. The modified low drop-out voltage regulator of claim 1, wherein each control gate of said first and second pass device of said output stage is in communication with said buffer output.

6. The modified low drop-out voltage regulator of claim 1, wherein said first and second pass device of said output stage are coupled to a power supply.

7. The modified low drop-out voltage regulator of claim 1, wherein said first and second pass device of said output stage are MOS transistors.

8. The modified low drop-out voltage regulator of claim 7, wherein said second pass device ranges in channel width from between about 2% to 15% of the width of said first pass device.

9. The modified low drop-out voltage regulator of claim 1, wherein said resistive means ranges from between about 0.2 ohm to 5 ohm.

10. A modified low drop-out voltage regulator, comprising:

an amplifier to amplify input signals, having as inputs an input node and a reference node, and an output node;

a buffer followed by a pmos transistor, said buffer having a buffer input node coupled to said amplifier output node and further having an output node;

a pass device of a current mirror, said pass device having an input node coupled to said buffer output node and having an output node, said pass device further comprising:

a first pmos transistor representing a first output side of said current mirror, the drain of said first pmos transistor coupled to said pass device output node;

a second pmos transistor representing a second output side of said current mirror, the drain of said second pmos transistor, in series with a resistor, paralleled to said first pmos transistor, the junction of said drain of said second pmos transistor and said resistor providing a feedback node;

a bond wire coupled at one end to said pass device output node and coupled at its other end to a low drop-out voltage regulator output node;

said resistor, in series with said bond wire, coupled to said low drop-out voltage regulator output node;

a main feedback loop to regulate an output voltage Vout at said low drop-out voltage regulator output node, where one end is coupled to the junction of said bond wire and said low drop-out voltage regulator output node and the other end is coupled to said amplifier input node; and a fast feedback loop to feed back high-frequency disturbances from said low drop-out voltage regulator output node, said fast feedback loop comprising a Miller feedback capacitor where one end of said fast feedback loop is coupled to said feedback node and where the other end is coupled to said buffer input node.

11. The modified low drop-out voltage regulator of claim 10, wherein said main feedback loop comprises a voltage divider having a center node and where further said center node is coupled to said amplifier input node.

12. The modified low drop-out voltage regulator of claim 10, wherein said main feedback loop receives said output voltage Vout, generated by a voltage divider comprising the resistance of said bond wire and an equivalent series resistance (ESR) of a load capacitor.

13. The modified low drop-out voltage regulator of claim 10, wherein said reference node of said amplifier receives a reference voltage.

14. The modified low drop-out voltage regulator of claim 10, wherein said buffer pmos transistor has its gate coupled to an output said buffer and wherein the source of said pmos transistor is coupled to said buffer output node.

15. The modified low drop-out voltage regulator of claim 10, wherein an input of said current mirror is coupled to said pass device input node.

16. The modified low drop-out voltage regulator of claim 10, wherein a common terminal of said current mirror is coupled to a positive terminal of said power supply.

17. The modified low drop-out voltage regulator of claim 10, wherein said second pmos transistor ranges in channel width from between about 2% to 15% of the width of said first pmos transistor.

18. The modified low drop-out voltage regulator of claim 10, wherein said resistor ranges from between about 0.2 ohm to 5 ohm.

19. A method of moving a high-frequency zero back into the bandwidth of a low drop-out voltage regulator, comprising the steps of:

a) providing a feedback input to an amplifier;

b) coupling a buffer to the output of said amplifier;

c) coupling a first pass device between the output of said buffer and a wire bond;

d) paralleling a second pass device, in series with a resistor, with said first pass device thereby creating an extra equivalent series resistance to move a zero of said low drop-out voltage regulator within its bandwidth;

e) coupling the second pass device in series with said resistor and said wire bond to the output of said low drop-out voltage regulator;

f) creating a main feedback loop from the junction of said bond wire and said output of said low drop-out voltage regulator to said feedback input of said amplifier; and g) creating a fast feedback loop from a junction of said second pass device in series with said resistor to an input of said buffer via a Miller capacitor.

20. The method of moving a high-frequency zero back into the bandwidth of a low drop-out voltage regulator of claim 19, wherein a reference input node of said amplifier receives a reference voltage.

21. The method of moving a high-frequency zero back into the bandwidth of a low drop-out voltage regulator of claim 19, wherein said second pass device ranges in channel width from between about 2% to 15% of the width of said first pass device.

22. The method of moving a high-frequency zero back into the bandwidth of a low drop-out voltage regulator of claim 19, wherein said resistor ranges from between about 0.2 ohm to 5 ohm.

* * * * *